US008490912B2

(12) United States Patent
Sanchez

(10) Patent No.: US 8,490,912 B2
(45) Date of Patent: Jul. 23, 2013

(54) ARBOR MOUNTED DISC ADJUSTING APPARATUS

(76) Inventor: Jesus H. Sanchez, Aurora, IL (US)

( * ) Notice: Subject to any disclaimer, the term of this patent is extended or adjusted under 35 U.S.C. 154(b) by 748 days.

(21) Appl. No.: 12/644,715

(22) Filed: Dec. 22, 2009

(65) Prior Publication Data

US 2011/0147168 A1 Jun. 23, 2011

(51) Int. Cl.
*B65H 75/24* (2006.01)

(52) U.S. Cl.
USPC ..... 242/571.5; 242/573

(58) Field of Classification Search
USPC ..... 242/525.6, 571, 571.5, 573, 573.1–573.3
See application file for complete search history.

(56) References Cited

U.S. PATENT DOCUMENTS 1,673,878 A * 6/1928 Leopold, Jr. et al. ..... 242/573.2
2,315,729 A * 4/1943 Nunnally ..... 101/375
2,696,354 A * 12/1954 Novick ..... 242/578.1
3,206,135 A * 9/1965 Uncapher ..... 242/573.2
3,586,254 A * 6/1971 McCabe ..... 242/573.2
3,587,371 A 6/1971 Sherwood
3,649,036 A 3/1972 Harz
3,761,008 A 9/1973 Goulder
3,815,840 A * 6/1974 Horton et al. ..... 242/571
4,694,559 A 9/1987 Lundy et al.
4,770,078 A 9/1988 Gautier
5,474,248 A 12/1995 Bradshaw et al.
6,434,994 B2 8/2002 Bradbury et al.

* cited by examiner

*Primary Examiner* — Sang Kim
(74) *Attorney, Agent, or Firm* — Mathew R. P. Perrone, Jr.

(57) ABSTRACT

An arbor mounted disc adjusting apparatus includes a tube that has a first end, a second end and a perimeter wall. The perimeter wall has a pair of elongated breaks therein extending through the first and second ends to partition the tube into a first section and a second section. A coupler retains the first and second sections together in a tubular configuration. An actuation assembly is mechanically coupled to the first and second sections to selectively move the first and second sections toward or away from each other. A plurality of separator discs is mounted on the tube so that the tube extends through the discs. The discs are movable on the tube when the first and second sections abut each other and are retained in place by friction between the discs and the tube when the first and second sections are moved apart from each other.

3 Claims, 5 Drawing Sheets

ARBOR MOUNTED DISC ADJUSTING APPARATUS

BACKGROUND OF THE DISCLOSURE

Field of the Disclosure

The disclosure relates to separator adjustment devices and more particularly pertains to a new separator adjustment device for allowing adjustments to the space between separators for the purpose of properly spacing strips of material.

SUMMARY OF THE DISCLOSURE

An embodiment of the disclosure meets the needs presented above by generally comprising a tube that has a first end, a second end and a perimeter wall extending between the first and second ends. The perimeter wall has a pair of elongated breaks therein extending through the first and second ends to partition the tube into a first section and a second section. A coupler retains the first and second sections together in a tubular configuration. An actuation assembly is mechanically coupled to the first and second sections to selectively move the first and second sections toward or away from each other. A plurality of separator discs is mounted on the tube so that the tube extends through the discs. The discs are movable on the tube when the first and second sections abut each other and are retained in place by friction between the discs and the tube when the first and second sections are moved apart from each other.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
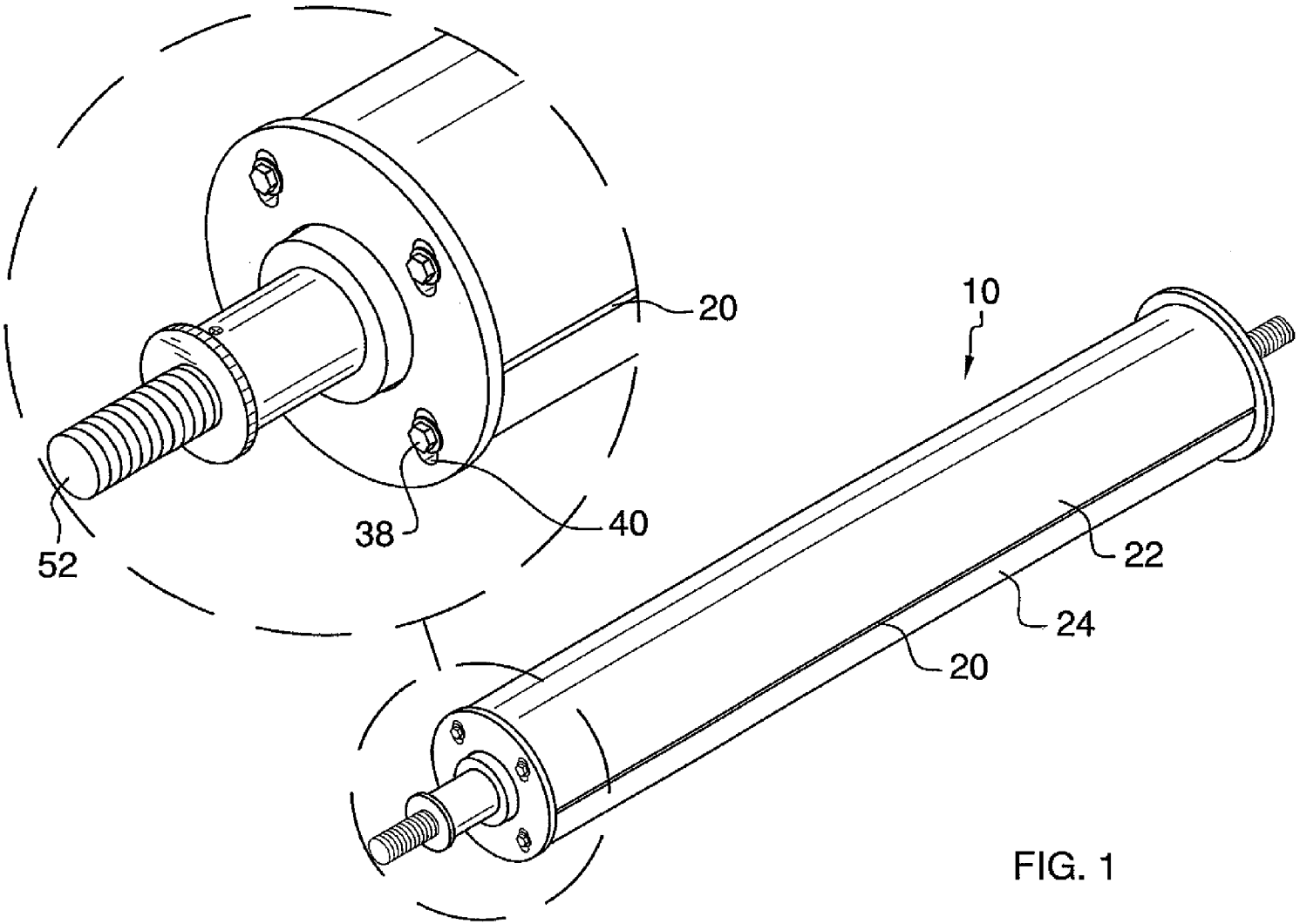
FIG. 1 is a perspective view of an arbor mounted disc adjusting apparatus according to an embodiment of the disclosure.
Figure 2:
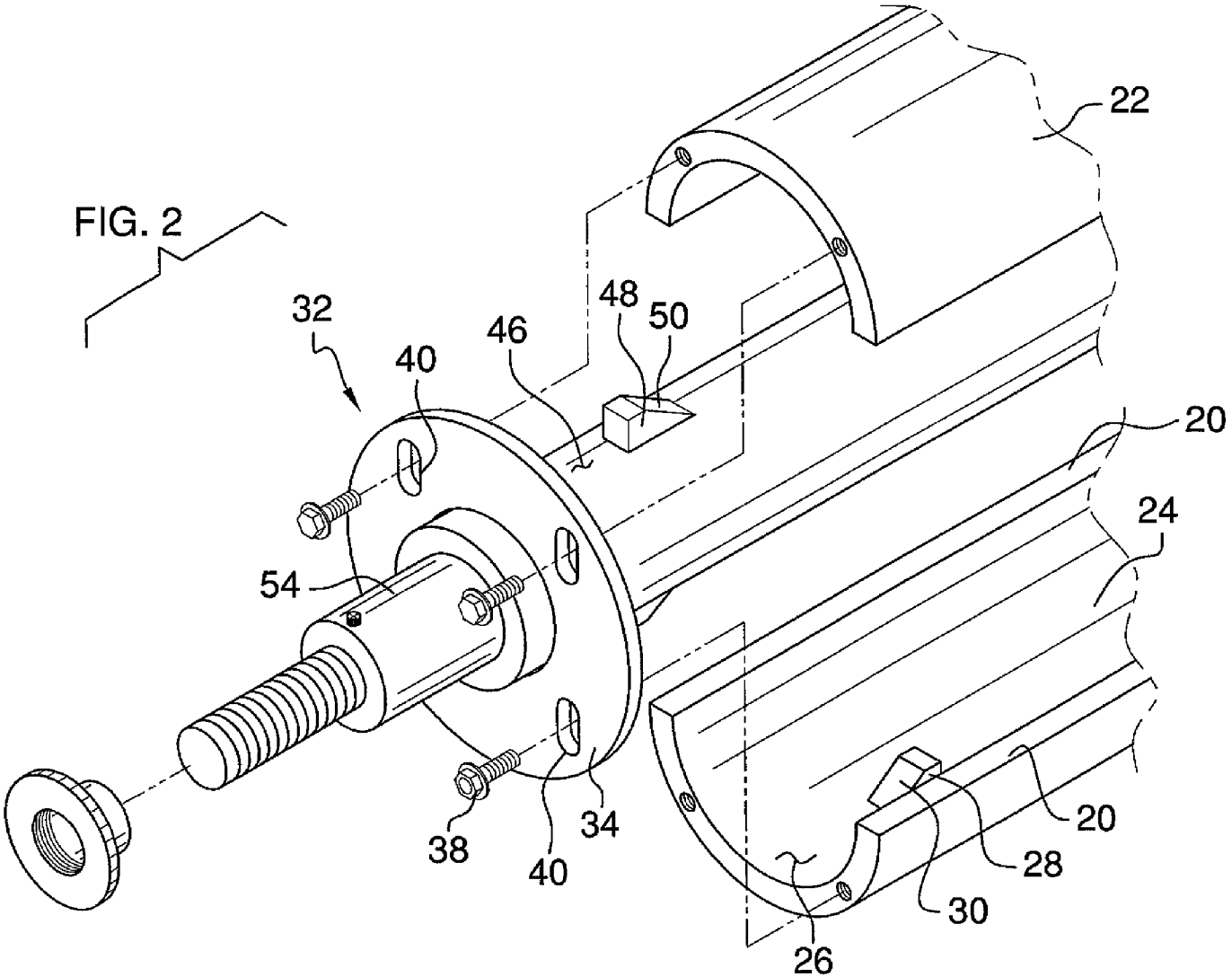
FIG. 2 is an exploded perspective view of an embodiment of the disclosure.
Figure 3:
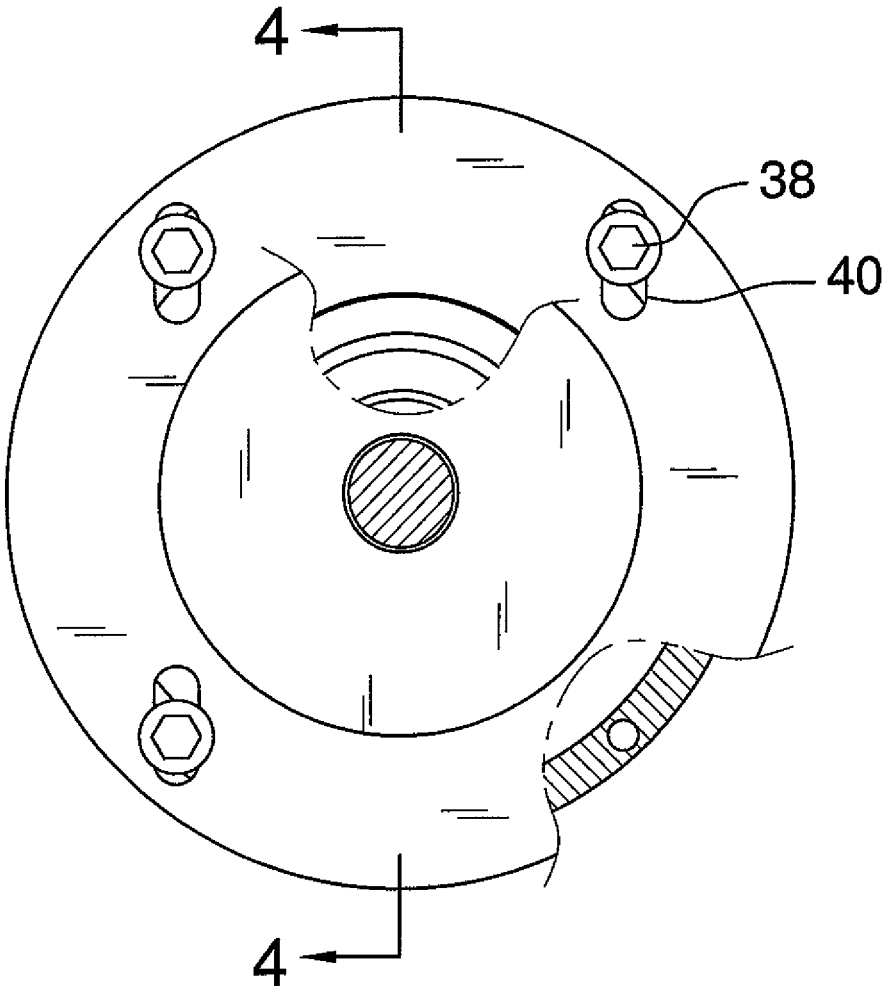
FIG. 3 is a broken end view of an embodiment of the disclosure.

With reference now to the drawings, and in particular to FIGS. 1 through 6 thereof, a new separator adjustment device embodying the principles and concepts of an embodiment of the disclosure and generally designated by the reference numeral 10 will be described.

As best illustrated in FIGS. 1 through 6, the arbor mounted disc adjusting apparatus 10 generally comprises a tube 12 that has a first end 14, a second end 16 and a perimeter wall 18 extending between the first 14 and second 16 ends. The perimeter wall 18 has a pair of elongated breaks 20 therein extending through the first 14 and second 16 ends to partition the tube into a first section 22 and a second section 24. The perimeter wall 18 has an inner surface 26 and the inner surface 26 has a plurality of protuberances 28 attached thereto. Each of the protuberances 28 has an angled edge 30 is angled outwardly from the inner surface 26 as the angled edges 30 extend away from the first end 14 and toward the second end 16.

A coupler 32 retains the first 22 and second 24 sections together in a tubular configuration. The coupler 32 includes a pair of plates 34, 36. Each of the first 22 and second 24 ends has one of the plates 34, 36 attached thereto to retain the first 22 and second 24 sections together in the tubular configuration approximating a cylinder. The term approximating is being used the tube 12 is widened when the first 22 and second 24 sections are moved apart from each other. However, the first 22 and second 24 sections are moved apart from each other less than 0.05" so that the deviation from a cylindrical shape is slight. More particularly, since the first 22 and second 24 sections may be cut from a single cylinder and the removal of material along the cut line would actually cause the shape to deviate from perfectly cylindrical when the first 22 and second 24 sections are abutted against each other and therefore as they are slightly spaced from each other, they more approximate a cylindrical shape. A plurality of bolts 38 attaches each of the plates 34, 36 to an associated one of the first 14 and second 16 ends. Each of the bolts 38 extends through expansion slots 40 in the plates 34, 36 to allow the sections 22, 24 to move toward or away from each other while is retained on the plates 34, 36.

An actuation assembly 42 is mechanically coupled to the first 22 and second 24 sections to selectively move the first 22 and second 24 sections toward or away from each other. The actuation assembly 42 includes a rod 44 that is mounted in the tube 12. The rod 44 has an outer surface 46 with a plurality of detents 48 thereon. Each of the detents 48 has a facing edge 50 facing one of the angled edges 30. Each of the facing edges 50 is angled outwardly from the outer surface 46 as the facing edges 50 extend away from the second end 16 toward the first end 14. The detents 48 urge the sections 22, 24 apart from each other as the rod 44 is moved toward the second end 16 and the facing edges 50 abut and move against the angled edges 30.

A shaft 52 extends through and is attached to the rod 44. The shaft 52 is threadably coupled to a knobs 53, 55 positioned adjacent to the plates 34, 36. The knob 53 is rotated with respect to the plate 36 in a first direction to move the rod 44 toward the second end 16 and the knobs 5 is rotated in a second direction to move the rod 44 toward the first end 14 to alter a spacing distance between the first 22 and second 24 sections. The other knob 55 may be used in likewise but opposite direction. A stop 54 is attached to the shaft 52 to prevent shaft 52 from being pulled away from the rod. A plurality of separator discs 56 is mounted on the tube 12 so that the tube 12 extends through the discs 56.

Figure 4A:
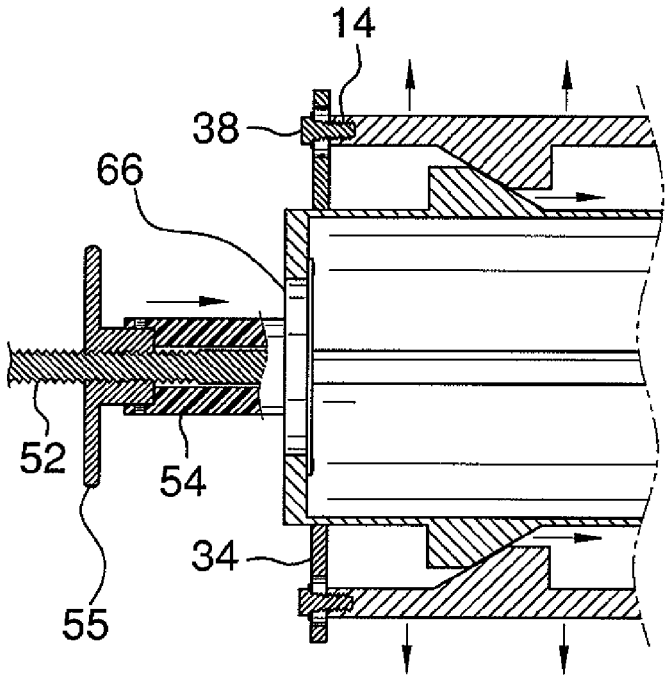
FIG. 4*a* is a cross-sectional view of an embodiment of the disclosure taken along line 4-4 of FIG. 3.
Figure 4B:
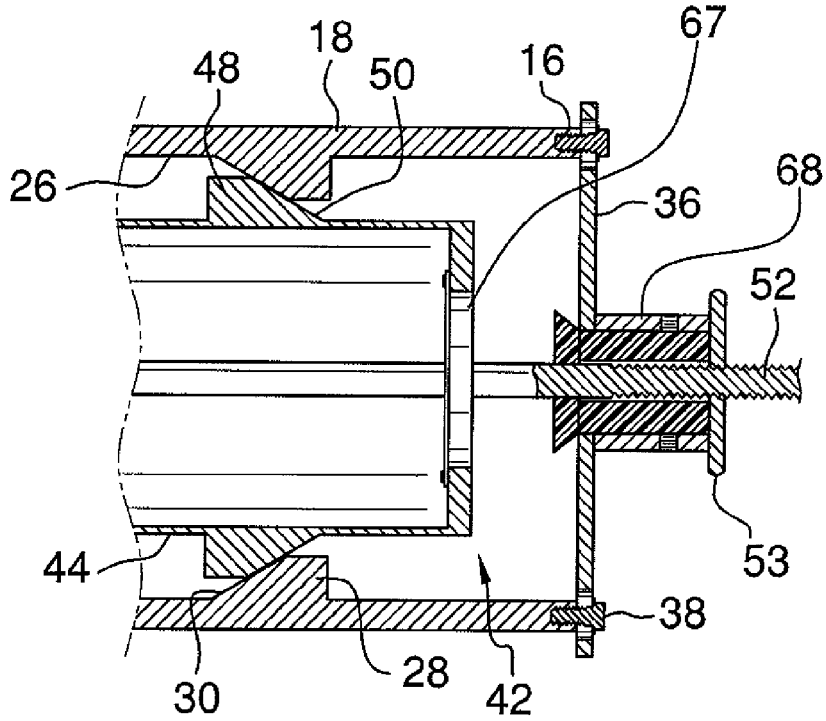
FIG. 4*b* is a cross-sectional view of an embodiment of the disclosure taken along line 4-4 of FIG. 3.
Figure 5:
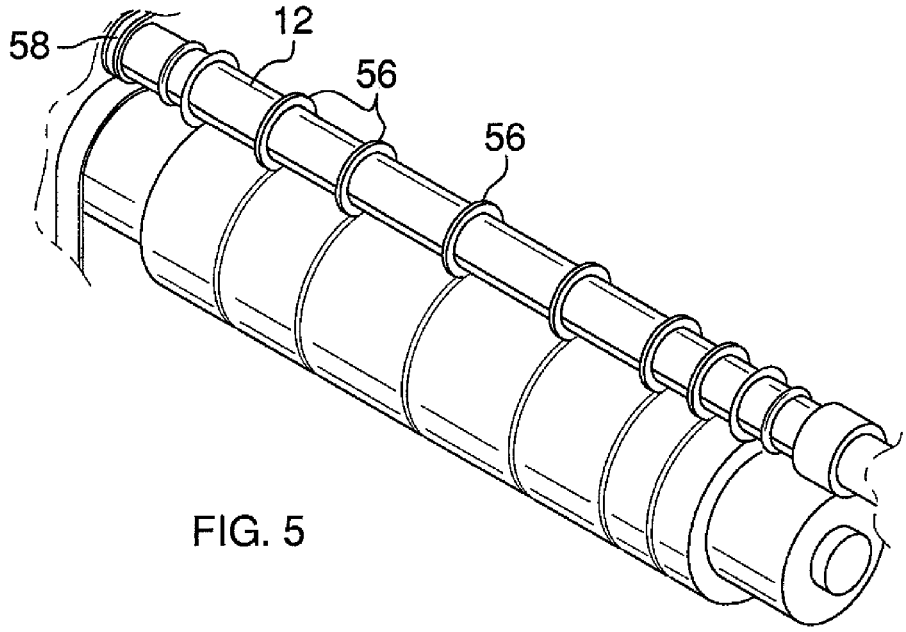
FIG. 5 is a perspective in-use view of an embodiment of the disclosure.

A plurality of bearings is used to insure the rod 44 is supported while the tube 12 spins on the shaft 52. These include a first bearing 66 which also forms a sleeve extending onto shaft 52 and a second bearing 67 shown in FIGS. 4*a* and 4*b*, respectively. FIG. 4*b* also includes third bearing 68 which supports plate 36 as it rotates with respect to the shaft 52.

Figure 6:
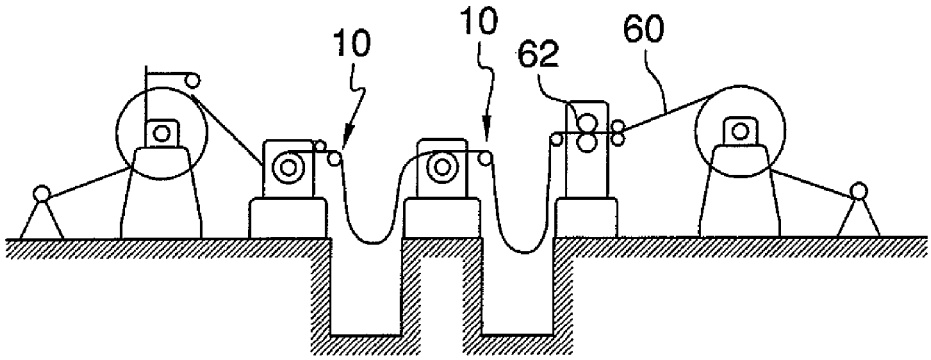
FIG. 6 is a side in-use view of an embodiment of the disclosure.

In use, the tube 12 is mounted to a drive wheel 58, belt or other driving assembly to rotate the tube. Strips 60 of material, such as metal, paper or plastic, which need to be separated after being formed into strips by a cutter 62, are positioned on the tube 12 so that the discs 56 can be used to space the strips 60 from each other. This requires the discs 56 to be moved as needed for both re-alignment purposes and as needed due to changes in strip widths. The actuation assembly 42 allows for a person to quickly and easily release the tension on the discs 56 so that they can be moved and then reapply tension on the discs 56 when they are positioned as needed. The discs may spin freely on the first 22 and second 24 sections depending on the strips of material. As shown in FIG. 6, multiple ones of the apparatuses 10 may be used with a paper, meatal or plastic cutting machine.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A separator adjustment apparatus to adjust spacing between rotary separating members, said apparatur comprising:

a tube having a first end, a second end and a perimeter wall extending between said first and second ends, said perimeter wall having a pair of elongated breaks therein extending through said first and second ends to partition said tube into a first section and a second section, said perimeter wall having an inner surface, said inner surface having a plurality of protuberances attached thereto, each of said protuberances having an angled edge being angled outwardly from said inner surface as said angled edges extend away from said first end and toward said second end;

a coupler retaining said first and second sections together in a tubular configuration, said coupler including;

a pair of plates, each of said first and second ends having one of said plates attached thereto to retain said first and second sections together in the tubular configuration approximating a cylinder;

a plurality of bolts attaching each of said plates to an associated one of said first and second ends, each of said bolts extending through expansion slots in said plates to allow said sections to move toward or away from each other while being retained on said plates;

an actuation assembly being mechanically coupled to said first and second sections to selectively move said first and second sections toward or away from each other, said actuation assembly including;

a rod being mounted in said tube, said rod having an outer surface, said outer surface having a plurality of detents thereon, each of said detents having a facing edge facing one of said angled edges, each of said facing edges being angled outwardly from said outer surface as said facing edges extend away from said second end toward said first end, said detents urging said sections apart from each other as said rod is moved toward said second end;

a shaft extending through and being attached to said rod, said shaft being threadably coupled to a knob abutting said plate attached to said second end, said knob being rotated with respect to said tubular member in a first direction to move said rod toward said second end and said knob being rotated in a second direction to move said rod toward said first end to alter a spacing distance between said first and second sections; and a plurality of separator discs being mounted on said tube so that said tube extends through said discs, said discs being movable on said tube when said first and second sections abut each other and are retained in place by friction between said discs and said tube when said first and second sections are moved apart from each other.

2. A separator adjustment apparatus to adjust spacing between rotary separating members, said apparatus comprising:

a tube having a first end, a second end and a perimeter wall extending between said first and second ends, said perimeter wall having a pair of elongated breaks therein extending through said first and second ends to partition said tube into a first section and a second section;

a coupler retaining said first and second sections together in a tubular configuration;

an actuation assembly being mechanically coupled to said first and second sections to selectively move said first and second sections toward or away from each other;

a plurality of separator discs being mounted on said tube so that said tube extends through said discs, said discs being movable on said tube when said first and second sections abut each other and are retained in place by friction between said discs and said tube when said first and second sections are moved apart from each other;

said perimeter wall having an inner surface, said inner surface having a plurality of protuberances attached thereto, each of said protuberances having an angled edge being angled outwardly from said inner surface as said angled edges extend away from said first end and toward said second end;

said actuation assembly including:

a rod being mounted in said tube, said rod having an outer surface, said outer surface having a plurality of detents thereon, each of said detents having a facing edge facing one of said angled edges, each of said facing edges being angled outwardly from said outer surface as said facing edges extend away from said second end toward said first end, said detents urging said sections apart from each other as said rod is moved toward said second end; and a shaft extending through and being attached to said rod, said shaft being threadably coupled to a knob, said knob being rotated toward said second end and said shaft being rotated in a second direction to move said rod toward said first end to alter a spacing distance between said first and second sections.

3. The apparatus according to claim 2, wherein said coupler includes:

a pair of plates, each of said first and second ends having one of said plates attached thereto to retain said first and second sections together in the tubular configuration approximating a cylinder, said shaft extending through said first and second plates, said know abutting said plate attached to said second end, and a plurality of bolts attaching each of said plates to an associated one of said first and second ends, each of said bolts extending through expansion slots in said plates to allow said sections to move toward or away from each other while being retained on said plates.

* * * * *